United States Patent [19]

Perkins

[11] 4,399,494

[45] Aug. 16, 1983

[54] DECORATIVE LAMP

[75] Inventor: David R. Perkins, Manchester, Mass.

[73] Assignee: Glass Dimensions, Inc., Magnolia, Mass.

[21] Appl. No.: 244,662

[22] Filed: Mar. 17, 1981

[51] Int. Cl.[3] ..... F21L 19/00

[52] U.S. Cl. ..... 362/163; 362/180; 362/190; 362/396

[58] Field of Search ..... 362/161, 163, 180, 396, 362/190

[56] References Cited

U.S. PATENT DOCUMENTS

| | | | |
|---|---|---|---|
| 1,295,679 | 2/1919 | Benson | 362/161 |
| 2,291,072 | 7/1942 | Dahle | 362/161 |
| 3,840,327 | 10/1974 | Kayne | 362/161 |

FOREIGN PATENT DOCUMENTS

| | | | |
|---|---|---|---|
| 4241 | of 1818 | United Kingdom | 362/180 |

*Primary Examiner*—Donald P. Walsh
*Attorney, Agent, or Firm*—Cesari and McKenna

[57] ABSTRACT

A decorative lamp comprises a chimney and an illumination source in the form of a candle or oil lamp. The oil lamp or candle is supported by an integral hanger that rests against the side of the chimney and provides an appropriate standoff to center the illumination source within the chimney. The hanger also has a hook that engages the top of the chimney and a leg that properly orients the illumination source vertically within the chimney.

5 Claims, 4 Drawing Figures

DECORATIVE LAMP

BACKGROUND OF THE INVENTION

This invention is generally related to lamps and, more specifically, to decorative lamps that utilize an oil-fed wick or a candle as an illumination source.

There are a wide variety of such decorative lamps on the market that utilize oil-fed wicks or candles as sources of illumination. This invention is particularly adapted to such decorative lamps in which the illumination source is disposed within and is supported by a transparent chimney. Examples of such lamps are shown in U.S. Pat. No. 3,473,014 and U.S. Pat. Nos. Des. 234,217; 234,367; and 249,180. In U.S. Pat. No. 3,473,014 three legs extend upwardly from a base to support a candle in the center of a chimney. In U.S. Pat. No. De. 234,217, a candle holder is positioned in the center of a chimney by means of a curved arm that is formed integrally with the chimney. U.S. Pat. Nos. De. 234,367 and 249,180 depict similar structures in which chimneys support an oil resevoir and wick holder through an integral support structure.

Thus, in each of these lamps the illumination source, be it a candle or an oil wick, must be positioned within the chimney when it is lit. This requires a person to light a match and extend the match downwardly into the chimney, thereby placing the match in a position which accelerates the advance of the flame up the match toward the fingers. Moreover, oil lamps tend to smoke if the wick height is not properly adjusted, and these structures prevent easy adjustment of the wick. Specifically, if the wick is not burning properly the flame must be extinguished. Then the wick is adjusted and the wick is again lit. Furthermore, the integral structure of these devices complicates the cleaning of the chimney and the supports. Fuel is also normally added through the support, which is formed as a tube, and requires some separate filling funnel and tube in order to enable the transfer of fuel into the reservoir.

SUMMARY OF THE INVENTION

Therefore, it is an object of this invention to provide an improved, decorative chimney lamp.

Another object of this invention is to provide an improved, decorative chimney lamp that is easy to light.

Yet another object of this invention to provide an improved, decorative chimney lamp that is easy to clean.

Yet still another object of this invention to provide an improved, decorative chimney lamp which uses an oil lamp and that is easy to fill and adjust.

The above objects are attained in accordance with my invention by constructing a decorative, chimney lamp with a transparent chimney and an illumination source that is positioned within the chimney. More specifically, a hanger is integrally connected at one end to the illumination source. The other end is formed into a hook portion that engages a rim on the chimney means, thereby to hang the illumination source in the chimney but allow that illumination source to be removed easily from the chimney.

This invention is pointed with particularity in the appended claims. The above and further objects and advantages of this invention may be better understood by referring to the following description taken in conjunction with the accompanying drawings.

DESCRIPTION OF AN ILLUSTRATIVE EMBODIMENT

Figure 1:
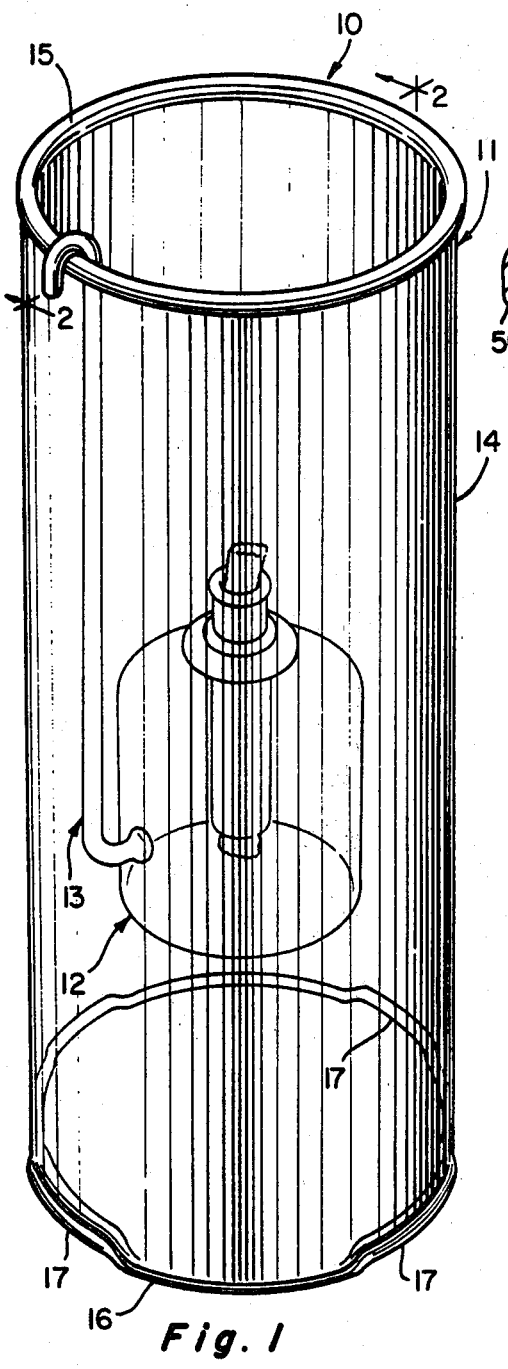
FIG. 1 is a perspective view of one embodiment of a decorative chimney lamp constructed in accordance with this invention.
Figure 2:
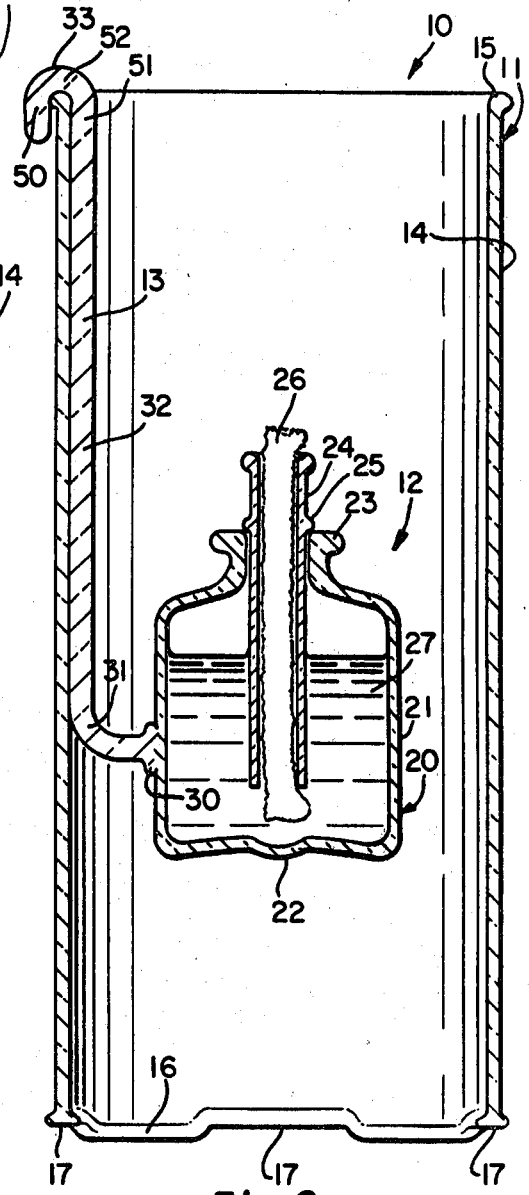
FIG. 2 is a cross-sectional view, taken along line 2—2 in FIG. 1.

Referring to FIGS. 1 and 2, my decorative lamp 10 includes a transparent chimney 11, an oil lamp 12 as a source of illumination, and a glass hanger 13. The chimney 11 is formed as a right cylinder 14, usually of glass. The cylinder 14 contains a first bead 15 at a top rim and a second bead 16 at a bottom rim. Portions of the second bead 16 are deformed to define ventilation ports through the bottom bead 16 when the chimney stands on a surface, thereby to allow air to enter the chimney at the bottom and blow upwardly past the oil lamp 12 for supporting combustion.

In the specific embodiment of my decorative lamp 10 shown in FIGS. 1 and 2, the oil lamp 12 includes an oil reservoir 20, also composed of glass, that has a cylindrical side wall 21, an integral bottom 22, and a necked opening 23 at the top. A glass wick support 24, is formed as a cylinder with an intermediate circumferential bead 25. The bead 25 locates the cylinder 24 in the reservoir 20 by interfering with the neck 23 at the opening. A wick 26 extends through the entire length of the support 24 and contacts oil 27 in the reservoir 20.

The hanger 13 includes a first end 30 that is integrally affixed to the wall 21. This arm extends horizontally for a predetermined length to a radiused portion 31 and then the hanger forms a vertical link 32. The predetermined length of the arm 30 establishes the standoff of the oil lamp 20 from the chimney 11 so the wick 26 is centered within the chimney 11. In position, the link 32 bears against the inner surface of the cylinder 14. The hanger 13 terminates at the other end in a hook portion 33. The distance between the radiused portion 31 and the hook 33, that is, the length of the link 32, is selected to properly orient the oil lamp 12 vertically within the chimney 11.

As will now be apparent, the illumination source, that is, the oil lamp 12, is removably supported within the chimney 11. Lighting and adjusting of the wick is therefore facilitated, as it is merely necessary to lift the entire oil lamp 12 from the chimney 11 by grabbing the hanger 13. The oil lamp 12 can then be lit externally to the chimney 11, adjusted, and replaced. The need to extend matches into the chimney 11 is eliminated. Moreover, cleaning is facilitated as the oil lamp 12 is easily removed.

Figure 3:
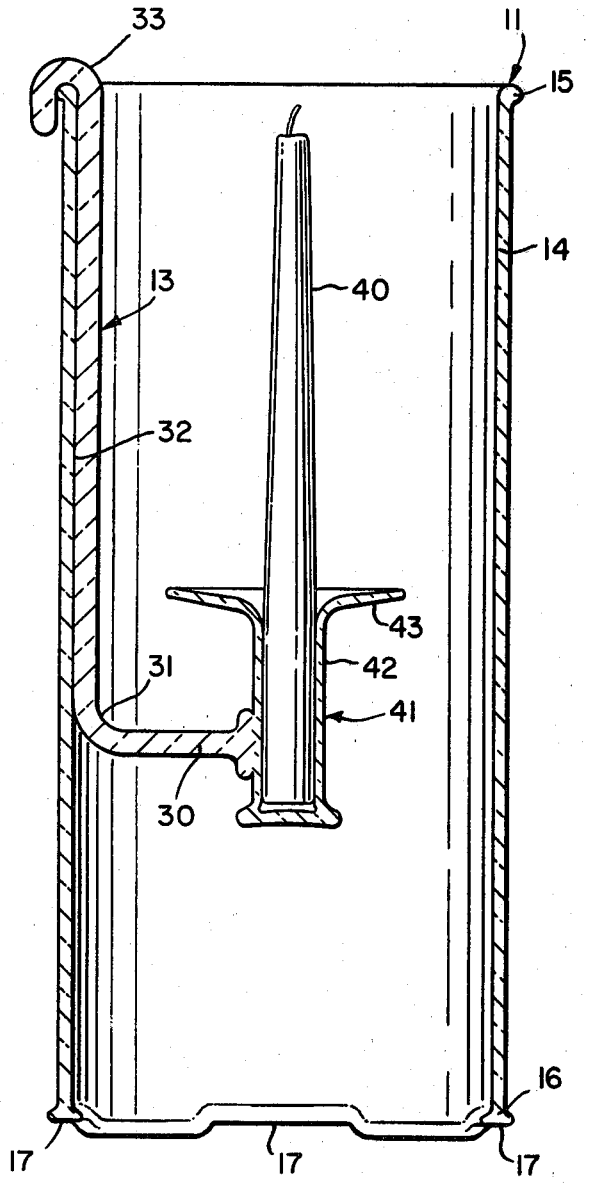
FIG. 3 is a cross-sectional view of a decorative lamp that utilizes a candle.

The structure shown in FIGS. 1 and 2 also is adapted to a decorative lamp that is easy to light and clean where the illumination source is a candle 40, as shown in FIG. 3. Like reference numerals are applied to designate elements in FIG. 3 where they are analogous to the elements in FIGS. 1 and 2. Referring to FIG. 3, the chimney 11 again is formed as a transparent, right cylinder 14 with an upper bead 15 and a lower bead 16 through which ventilation apertures 17 are formed. The candle 40, in this particular embodiment, is supported in a glass holder 41 that includes a vertical, closed cylinder 42 with a flared opening portion 43 at the top. The candle 40 extends into the cylinder 42 and the flared portion tends to catch any wax that melts while the candle is burning. The arm 30 on the hanger 13 is integrally connected to the cylinder 42 and has a length that provides the appropriate standoff from the side wall of the cylinder 14 to center the candle 40. Similarly, the length of a central link 32 between the radiused portion 31 and the hook portion 33 is selected to properly orient the candle 40 vertically in the chimney 11.

As shown in FIGS. 1 through 3, the hook is formed with a substantially 180° bend to form a U-shaped hook portion 33 with spaced arms 50 and 51 and a connecting radius 52. The distance between the arms 50 and 51 is selected so the inner surfaces of those arms touch the bead 15, but allow the hook portion 33 to slide over the bead 15. This provides a certain lateral stability for the illumination source, be it either the oil lamp 12 in FIGS. 1 and 2 or the candle 40 in holder 41. Other hook arrangements can also be used with greater or less lateral stability being provided.

Figure 4:
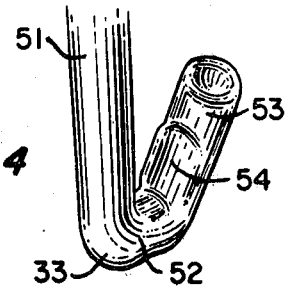
FIG. 4 is a detailed, enlarged, perspective view of a portion of a hanger that is shown in FIGS. 1 and 2.

One particularly suitable hook structure is shown in FIG. 4, which is a perspective view of an inverted hook portion 33. The arm 51 in FIG. 4 is spaced from an arm 53 that connects to the arm 51 through a radius 52. However, in this case the bend more closely approximates 135° rather than the 180° shown in FIGS. 1 through 3, although the specific angle is not critical. Thus, the hook 33 in FIG. 4 more closely approximates a V-shape. Moreover, in this embodiment the hook 33 is formed by heating the glass and forming it around a mold that forces a compound curved depression 54 into the arm 53. The depression is formed to be coextensive with at least a portion of the bead 15. It has a radius in a vertical and a radius in a horizontal direction. With this particular structure, any lateral movement of the hanger and the illumination source it supports is very limited, so the illumination soruce is supported in a stable manner in the lateral direction.

My invention has thus been described in terms of two, specific, decorative lamps, one using an oil lamp and the other using a candle. However, it will be apparent to those of ordinary skill in the art that many variations in these specific relationships and structures can be utilized with the attainment of some or all of the objects and advantages of this invention. Therefore, it is the intention of the appended claims to cover all such modifications as come within the true spirit and scope of this invention.

What is claimed as new and desired to be secured by Letters Patent of the United States is:

1. A chimney lamp comprising

A. tubular chimney means made of transparent glass or plastic, said chimney means having an upper edge defining an open upper end and a lower end for resting on a surface;

B. illuminator support means for supporting a wick and a fuel supply for the wick, said support means also being made of transparent glass or plastic; and C. elongated transparent glass or plastic hanger means, said hanger means having one end connected to the support means and its other end formed as a hook for removably engaging over said upper edge of the chimney means so as to suspend the support means at a central location in the chimney means appreciably below the upper end thereof for permitting the supporting means and the wick and fuel supply supported thereby to be lifted out of the chimney means by way of the hanger means.

2. The chimney lamp defined in claim 1 wherein

A. the chimney means is a glass cylinder having upper and lower beaded rims; and B. apertures are formed through the chimney means at the lower beaded edge thereof.

3. A chimney lamp as recited in claim 2 wherein said hooked end of said hanger means includes a deformation on the inner surface thereof that conforms to the configuration of said upper beaded rim.

4. A chimney lamp as recited in claim 1 for supplying illumination from a candle, said support means including flared candle support means integrally connected to said one end of said hanger means for supporting the candle centrally in said chimney means.

5. A chimney lamp as recited in claim 1 for supplying support from an oil-fed wick, said illumination means including oil reservoir means integrally connected to said one end of said hanger means with a top opening therein for containing oil and wick support means supported by said oil reservoir means in the top opening for supporting the wick centrally in said chimney means and in contact with the oil.

* * * * *